United States Patent [19]

Lobur

[11] 4,103,889

[45] Aug. 1, 1978

[54] COLLAPSIBLE BAG FOR IMPACT ABSORBING ACTIVITIES AND METHOD OF MAKING

[76] Inventor: Terry J. Lobur, 1914 Walbrook Ave., Cleveland, Ohio 44109

[21] Appl. No.: 673,430

[22] Filed: Apr. 5, 1976

[51] Int. Cl.[2] ..... A63B 67/00; A63B 69/00

[52] U.S. Cl. ..... 272/77; 273/55 A; 273/DIG. 20

[58] Field of Search ..... 272/76, 77, 78; 273/55 R, 55 A, DIG. 20

[56] References Cited

U.S. PATENT DOCUMENTS

| | | | |
|---|---|---|---|
| 124,588 | 3/1872 | Kehoe | 272/77 |
| 2,197,545 | 4/1940 | Bachman et al. | 272/77 X |
| 2,203,259 | 6/1940 | Gilman | 272/77 X |
| 3,111,317 | 11/1963 | Cituk | 273/55 A |

*Primary Examiner*—George J. Marlo
*Attorney, Agent, or Firm*—Watts, Hoffmann, Fisher & Heinke Co.

[57] ABSTRACT

A collapsible bag is disclosed which when expanded is capable of sustaining and absorbing impact and which is suitable for use in physical conditioning activities such as karate punching and kicking techniques. An elongate flexible casing is provided which is supportable at one end. A collapsible envelope, which may be an inflatable air bladder, is disposed within the casing. A portion of the exterior surface of the bladder defines a cavity or recess for receiving a weighting material. Sufficient weighting material is disposed in the cavity to impart to the bag a desired impact absorption characteristic. The bladder is inflated by the user of the bag to cause the bag to be hardened to a desired level.

8 Claims, 2 Drawing Figures

COLLAPSIBLE BAG FOR IMPACT ABSORBING ACTIVITIES AND METHOD OF MAKING

BACKGROUND OF THE INVENTION

This invention relates generally to bags employed in impact absorbing activities and more particularly to a collapsible bag which is useful in a variety of physical conditioning activities and which may be assembled by the user so he may selectively control both its hardness and its impact absorption characteristic.

Impact absorbing bags in various forms are well known in the prior art, particularly for purposes of physical conditioning. Such bags are useful as an aid in teaching punching and kicking techniques to students of karate. Boxers and military personnel have a long history of using impact absorbing bags as part of their conditioning process. Football coaches may employ impact absorbing bags as tackling dummies.

One physical conditioning bag currently known comprises an elongate flexible casing which is lined with foam sheet material along its interior lateral and bottom surfaces. The bag is then filled with a lightweight scrap material to provide bulk for the bag. Small packages of sand or other weighting material are disposed generally centrally of the bag's length within the scrap material and away from the walls of the bag to give the bag the desired impact absorption characteristic.

This prior art conditioning bag is characterized by several disadvantages. First, its structure makes it a relatively expensive bag to manufacture. This bag employs a relatively thick (2 – 3 inches) foam lining cushion material which is expensive initially from the standpoint of material cost. Additionally, this bag has a relatively complicated structure which makes it more desirable for a manufacturer, rather than a user, to assemble the bag. This same complicated structure makes the bag expensive to assemble because of the amount of manual labor required. The relatively thick foam lining must initially be fitted into the flexible casing. Thereafter, in a time consuming process, scrap material must be stuffed into the bag by hand with small packages of weighting material being disposed within the body of scrap material. A manufacturer assembling this bag has the further expense of maintaining an inventory of bulky, space consuming foam sheet material and scrap stuffing material, as well as heavy sand. All these costs must be passed on to the purchaser of the bag.

This known bag is also disadvantageous because once assembled, its hardness to contact and its impact absorption character are not adjustable by the user. Generally individual ones of such bags are purchased for use by a number of users in a karate dojo or gymnasium. The users may range over an entire spectrum, from inexperienced, relatively weak children to experienced, physically strong adults. It is clear that some individuals, by the nature of their lesser ability and strength would benefit more by practicing their punching and kicking techniques on a lighter weight, softer bag which would respond more to their blows than a heavier harder bag. Additionally the use of a too heavy, too hard bag by an insufficiently strong or skilled student can lead to injury. Such a student might find the reacting shock imparted to him upon his striking a too heavy bag too great for his striking arm or foot to absorb comfortably. On the other hand a more skilled student might not be sufficiently challenged by a too light bag. Too light a bag would respond by dancing wildly under his blows, be hard to strike rapidly because of that response, and not cause the more skilled student to exert himself. Most facilities serving a number of people of varying skills and strengths would not be in a position to buy a number of bags of varying hardness and impact absorption characteristics to suit all their users.

A third disadvantage is that once the bag is assembled by the manufacturer it must be shipped to the consumer who must bear the transportation cost, not only for the casing, but also for bulky and heavy stuffing materials.

A fourth disadvantage is that this prior art bag is subject to breakdown from the punishment it endures, which breakdown results in a change in both the punching surface and the impact absorption characteristics of the bag. The breakdown arises when the packages of sand rupture and the sand works its way through the scrap material to the bottom of the bag. As a result of this breakdown, the bottom surface of the bag becomes very hard due to the sand accumulation there. The upper lateral surface portions of the bag become much softer because the breakage of the sand packages has permitted adjacent scrap material to migrate and fill the voids left by the breakdown of the sand packages. Consequently, less scrap material is available to keep the lateral surfaces of the bag firm. Thus, the punching surface of the bag changes. Additionally, with the punching surface softened and the sand accumulated at the bottom of the bag, the impacts delivered to the bag by a user are not absorbed in the way they would be if the surface was hard. The soft surface gives under the impacts and does not transmit them directly to the accumulated sand. As a result, this prior art bag upon breakdown, tends to dance wildly upon impact.

A fifth disadvantage is that once such a bag is assembled it is not particularly portable. Considering the fact that athletes, particularly serious students of karate, will attend competitive meets and will be desirous of working out prior to the competition, it would be desirable if their workout bags could be easily transported to such a meet. The prior art bag, once assembled, is a bulky, heavy object which is not amenable to transport. No advantage would be obtained by disassembling the bag, transporting its casing alone to the meet, and reassembling the bag at the meet with components available there. The bag's components i.e., relatively non-breakable sand packages, scrap material, and relatively thick foam liner, would not be readily or cheaply available at the meet. Even if they were available it would be a major task to tear down and reassemble the bag.

A sixth disadvantage is that once such a bag is assembled, it will commonly have a rather bumpy appearance which is not particularly pleasing to the eye.

Other types of impact absorbing bags are known in the prior art. These do not overcome all the above noted disadvantages. A bag useful for conditioning boxers is shown in U.S. Pat. No. 2,156,831. The bag comprises an elongate flexible leather casing which is filled with sand or other material. The bag is dimensioned so that when filled it presents an approximately life size target for the boxer. The mass of sand required to fill the bag gives the bag its impact absorption quality. The use of such sand filler, contiguous with the interior of the bag, makes the surface of the bag hard to the touch. Gloves are generally used with such a bag and once assembled, the physical characteristics of the bag are not adjustable.

Another bag, shown in U.S. Pat. No. 2,344,360, comprises an elongate flexible casing filled with scrap material such as cotton fibers. This conditioning bag is necessarily lighter in weight than the sand filled bag and could be used without gloves. However, once formed, its physical characteristics are also fixed.

It is therefore an object of this invention to provide such a bag which overcomes the aforementioned disadvantages and more particularly to provide such a bag for impact absorbing activities which is simply constructed so that it may be transported in a collapsed compact condition and then be readily assembled by the user.

It is a further object of this invention to provide such a bag which is expanded to a usable condition by the use of fungible, readily available bulk forming and weighting materials supplied by the user thereby obviating the need to ship the same with the collapsed bag.

It is another object of this invention to provide such a bag which, upon assembly, is easily adjustable both with respect to its hardness and its impact absorption characteristics.

These and other objects are obtained by a preferred construction including a flexible casing and a collapsible envelope disposed within the casing. The interior of the envelope is adapted to receive and contain material for expanding the envelope within the casing. When the envelope is expanded within the casing, the exterior surface of the envelope defines an open, erect cavity which is accessible from outside the casing. The erect cavity is adapted to receive material for imparting a selected weight to the bag.

An important feature of the described embodiment resides in the utilization of an envelope which comprises a generally elongate annular shape. The core of the elongate angular envelope is opened to permit access from the casing exterior so that any desired weight of filler material, within the capacity of the bag cavity, may be disposed in the cavity by the bag's user to impart a desired impact absorption characteristic to the bag.

Another important feature is the employment of a hermetic envelope which includes a compressed air valve. The user of the bag is thus able to himself inflate or deflate the envelopes with compressed air to produce a desired hardness in the bag.

Still other features, advantages and full understanding of the invention will be had from the following detailed description when taken in conjunction with accompanying drawings.

DESCRIPTION OF THE PREFERRED EMBODIMENT

Figure 1:
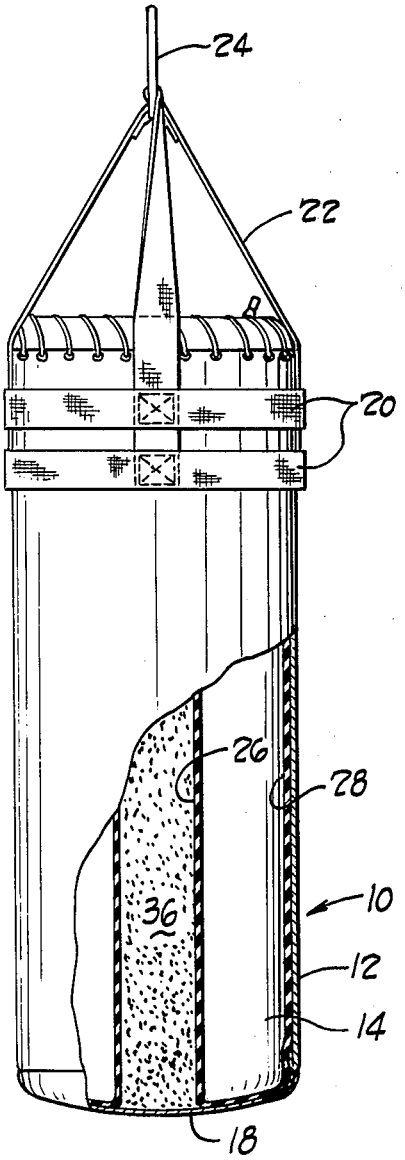
FIG. 1 is an elevational view of the impact absorbing bag of the present invention.
Figure 2:
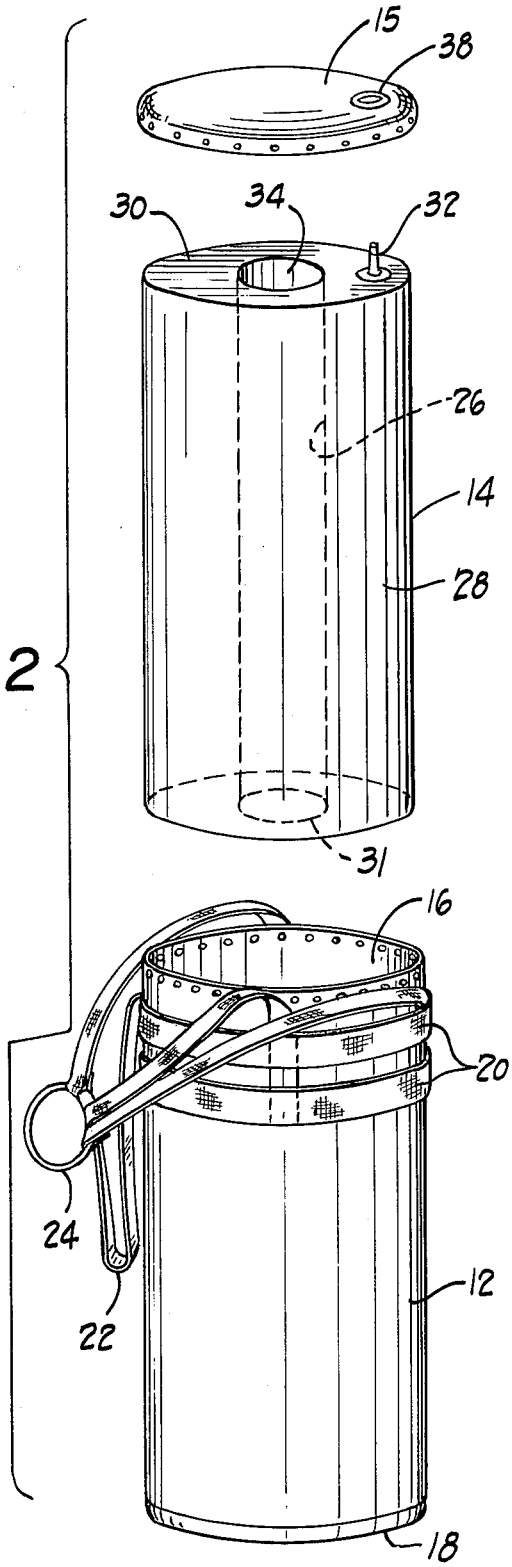
FIG. 2 is an exploded view of the bag illustrated in FIG. 1.

Referring to the drawings, and to FIG. 1 in particular, the illustrated embodiment of the impact absorbing bag 10 comprises an elongate cylindrical flexible casing 12 within which a collapsible envelope 14 is disposed and expanded. Referring to FIG. 2, the flexible casing 12 is open at its top end 16 to provide access to the casing interior. The bottom end of the casing 18 is closed to prevent such access. The cylindrical casing is provided proximate its top end with a pair of spaced, similar attachment webs 20 which are sewn around the periphery of the casing. These webs 20 provide anchor points for four spaced support belts 22 which are sewn to the attachment webs 20 and which extend therefrom to a support ring 24. The ring 24 is intended for mounting to some fixed support to thus support the bag 10 in a suspended condition.

In this preferred embodiment the collapsible envelope 14 comprises an inflatable hermetic bladder which, when inflated, assumes a generally elongate annular shape. The envelope 14 comprises an inner cylindrical wall portion 26 and an outer cylindrical wall portion 28. When the bladder is inflated, the outer cylindrical wall portion 28 is disposed in a generally concentric relationship about the inner wall portion 26 and in spaced relationship thereto. The inner and outer wall portions 26, 28 are substantially similar in length and generally transversely aligned. A pair of similar annular end panels 30, 31 are disposed at opposite ends of the aligned cylindrical wall portions 26, 28 to close off the opposite ends of the bladder between the respective inner and outer cylindrical walls. Each annular panel has an inner and an outer periphery. The inner periphery of each annular panel hermetically engages the adjacent end of the inner cylindrical wall portion 26 and the outer periphery of each such annular panel hermetically engages the adjacent end of the outer cylindrical wall portion 28. The annular panel 30 is additionally provided with an air valve 32 which enables the bladder to be inflated with compressed air.

The bladder 14, so formed, may then be disposed in the casing 12 and initially partially inflated against the interior lateral and bottom walls of the casing. The partial inflation process serves to erect a portion of the exterior surface of the bladder around an open cavity 34 which is centrally disposed of the annular bladder. The cavity 34 may be partially or completely filled with a filler material 36. The filler material may alternatively be disposed directly in the cavity 34 or it may be put into a receptale which is disposed in the cavity. The bag will thus reach a desired weight, and thus be characterized by a desired impact absorption characteristic. Thereafter, the bladder 14 is further inflated to produce the desired bag hardness which is compatible with the skill and ability of the user of the bag. If desired, the cavity 34 may be filled after the bladder has been inserted in the casing 12 but before it has been inflated. In whatever condition the bladder is in when filler material is added, if the cavity has been only partially filled with filler material 36 the section of inner wall portion 26 extending above the top level of the filler material will tend to collapse on to the filler material and retain the filler material in place within the cavity when the bladder is eventually fully inflated. A cover 15 is then disposed over the casing opening 16 and attached to the casing 12 to close off access to cavity 34. The cover is provided with an aperture which supports a grommet 38. The grommet is adapted to receive air valve 32. Thus, the air valve is easily accessible from the bag exterior so that the bladder pressure may readily be varied without having to otherwise disturb the bag structure.

The bag of this invention is not limited to an annular bladder 14. Any bladder is suitable which has an inflated shape compatible with the casing within which it is disposed and which defines a material receiving cavity readily accessible from without the casing.

The casing 12 of this invention may be formed of any of a variety of conventionally available materials. For example, canvas duck (either No. 6 or No. 8) may be employed. Alternatively, reinforced vinyl (either 18 oz., 22 oz., 32 oz., or 50 oz.) may be used.

The bladder 14 of this invention has been formed from a vinyl sheet material which is 0.020 inch thick. The sheet material was chemically impregnated to prevent or minimize mildew, fungus, etc. The annular end panels were formed with thirteen inch outside diameters and six inch inside diameters. The inner and outer cylinder wall portions ranging in length from 24 to 42 inches were formed from rectangular panels whose opposite edges along the length of the panels were overlapped and hermetically joined.

Hermetic engagement of the end panel peripheries with ends of the inner and outer wall portions and also of the overlapping edges of inner and outer wall portions was achieved in several ways. One desirable way was to place the members to be joined in appropriate dies and then to employ a dielectric heating process to join the respective peripheries and ends and also to join the respective overlapping edges. Another alternative was to sew the adjacent pieces of the bladder together and then seal the needle holes in the vinyl with an appropriate sealer or vinyl adhesive.

As an additional feature, the bag 10 of this invention may optionally be provided with means to measure the striking power of a user of the bag. This was achieved by measuring the impact of a blow struck at the bag with a pressure gauge. The gauge was disposed in communication with the bladder interior. It has been discovered that the change in the air pressure within the bladder generated upon impact was quite low. Thus, a diaphragm gauge having a sensitivity range of up to 20 ounces/sq. inch was found quite suitable.

As another additional feature, the bag 10 may optionally be provided with a relatively thin foam liner (approximately one inch thick) which will be disposed in the bottom of the casing and along the sidewalls of the casing between the casing and the bladder. While not required for satisfactory use of the bag, the thin liner does add to the comfort of the use of the bag 10.

The construction of the bag incorporating this invention makes it relatively inexpensive to manufacture and sell. The requirement for costly thick foam materials is eliminated. If a foam liner is employed at all, it is only as an optional feature for the comfort of the user of the bag. Moreover, since the optional foam liner which would be employed would be only one-half to one third as thick as the foam liner required in prior art bags, there would be an equivalent cost savings, materialwise. The need for the manufacturer to inventory bulky foam, scrap material and sand is also eliminated. Finally, the need to ship such materials within an assembled bag to a user is eliminated and the shipping costs are reduced considerably.

The bag's air bladder construction contributes to produce a smooth appearing finished product with a clear profile and without the bumpy appearance characteristic of prior art bags.

This bag's simple construction makes easy to assemble and disassemble. The bag, disassembled with the bladder collapsed, is very portable and may be readily shipped from the manufacturer or seller to the user. Moreover, the user may readily transport the disassembled bag from place to place under his arm or in the corner of a suitcase. Even if the optional foam liner is employed, the disassembled bag is still compact to facilitate its transportation. Once the user is at a location where the bag is to be used, the only supplies needed to assemble the bag to a usable mode are compressed air and a filler material, e.g., sand. Both of these commodities are readily available. Compressed air may be provided, depending on the type of bladder valve employed, with something as simple as a bicycle pump. Sand is generally available. If it should not be, then dirt or other similar filler material will work quite adequately.

The bag's construction also makes it amenable to ready adjustment. The user can make the bag harder or softer to the touch by merely adding or removing air from the bladder. He can increase or decrease the impact resistance by merely adding or removing filler material from the readily accessible cavity 36. A bag incorporating this invention is thus highly desirable for use in a facility serving a number of people having skills and strength ranging over a spectrum.

For individuals who have relatively low strength and skill, the bag can be made lighter and softer because less impact absorption is required. For individuals who are stronger and more skilled and who can skillfully strike a blow to such a bag, a heavier harder bag will be needed just to challenge them. Since such facilities generally can't afford to purchase individual bags for each of its individual users, the bag incorporating this invention fills a need unmet by prior art conditioning bags.

The bag incorporating this invention is also advantageous because it overcomes the problem of breakdown and consequent varying bag characteristics with which prior art bags were afflicted. The striking surface of the bag of this invention is always maintained relatively firm by the inflated bladder. Any impacts delivered to the bag by a user will be transmitted directly to the sand or other filler material which will absorb them. If it is desired to soften the bag and adjust its impact absorbing characteristics the user may do it at his option to whatever extent he desires.

The constant striking surface characteristic of the bag is advantageous because the firm bag effected by the inflated bladder transmits impacts directly to the column of sand in cavity 34 even though the cavity may only be half full. For purposes of this improved impact absorbing bag, the vertical location of the center of mass of the column of filler would seem to have no significant effect on the bags impact absorbing quality. Assuming a firm bag punching surface, only the magnitude of the filler material in the cavity 34 would seem to be determinative of the bags impact absorbing characteristics.

This bag is not limited to use as a physical conditioning bag for any particular type of activity, but may within the contemplation of this invention be used as a training bag in a variety of body contact sports such as karate, boxing, and football. The bag may even be put to different uses than for impact absorption activities. For example, the bag may be used for exercises in developing a person's reflexes. For use in such exercises, the bottom of the bag would be attached to a support below the bag while the bag would be suspended from another support above the bag. The cavity 34 would be empty and the bag would function similarly to "striking bags" well known in the karate art. It is also within the contemplation of this invention that this bag may be used in one form or another as a child's amusement device. If used as a child's amusement device, it may be desirable to put no filler material whatsoever in the cavity.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A method of constructing a collapsible bag for use in impact absorbing activities, comprising:
   (a) providing a flexible casing having an opening,
   (b) disposing within said casing a collapsible envelope which defines a material receiving recess in communication with said opening;
   (c) disposing a generally granular weighting material through said opening into said recess to produce a controlled impact absorption capability in said bag; and
   (d) expanding said envelope within said casing to produce a controlled hardness in said bag and generally to retain the material in situs.

2. The method of claim 1 wherein said expanding of said envelope to produce a controlled hardness in said bag also adjusts the volume of said recess to equal the volume of the weighting material contained therein and thus firmly engage and retain said weighting material within said recess.

3. A collapsible bag for use in athletic impact absorbing activities, comprising:
   (a) a flexible casing,
   (b) a collapsible and inflatable envelope disposed within said casing, the envelope being adapted to be inflated to expand said envelope within said casing,
   (c) a recess defined by said envelope;
   (d) a quantity of generally granular weighting material removably contained within the recess;
   (e) access means for providing access through said casing to said recess to enable selective addition or removal of weighting material to or from said recess to thereby impart a selected weight to said bag; and,
   (f) said envelope being inflated when in use to envelope and retain the weighting material in place.

4. The collapsible bag of claim 3 wherein said casing comprises an elongate generally cylindrical member, said envelope comprises a cylindrical member, and said recess comprises a through passage disposed generally coaxially of the longitudinal axis of the cylindrical member which recess is essentially closed by the inflated bag except for that portion of the recess which houses the weighting material.

5. The bag of claim 4 wherein the transverse dimension of said through passage is sufficiently large to enable hand insertion or removal of weighting material from said passage.

6. The bag of claim 4 wherein said collapsible envelope includes fluid valve means communicating between the interior and exterior of said envelope for enabling controlled inflation of said envelope.

7. The bag of claim 6 wherein said valve means is adapted to communicate compressed air between the interior and exterior of said envelope.

8. The collapsible bag of claim 3 wherein said envelope comprises:
   (a) inner and outer cylindrical walls of distinct diameters and similar lengths,
   (b) said inner wall nested within and coaxially of said outer wall, said ends of said walls being transversely aligned, and
   (c) a pair of similar annular end panels each having an inner and an outer periphery, one end panel disposed proximate each end of the aligned wall portions, the outer periphery of each said panel hermetically engaging the adjacent end of said wall portion and the inner periphery of the said panel hermetically engaging the adjacent end of said inner wall portion.

* * * * *